US006247753B1

(12) United States Patent
Alvestad

(10) Patent No.: US 6,247,753 B1
(45) Date of Patent: Jun. 19, 2001

(54) ARRANGEMENT FOR BEDS AND OTHER RECLINING OR SEATING FURNITURE

(76) Inventor: Kjartan Alvestad, N-6222 Ikornnes (NO)

( * ) Notice: Subject to any disclaimer, the term of this patent is extended or adjusted under 35 U.S.C. 154(b) by 0 days.

(21) Appl. No.: 09/380,156

(22) PCT Filed: Feb. 25, 1998

(86) PCT No.: PCT/NO98/00056

§ 371 Date: Aug. 26, 1999

§ 102(e) Date: Aug. 26, 1999

(87) PCT Pub. No.: WO98/37791

PCT Pub. Date: Sep. 3, 1998

(30) Foreign Application Priority Data

Feb. 28, 1997 (NO) ..... 970950

(51) Int. Cl.[7] ..... A47C 1/02; B60N 2/02

(52) U.S. Cl. ..... 297/362.13; 297/317; 297/342; 297/354.13

(58) Field of Search ..... 297/354.13, 362.13, 297/317, 325, 342

(56) References Cited

U.S. PATENT DOCUMENTS

| | | | | |
|---|---|---|---|---|
| 2,468,765 | | 5/1949 | Lorenz . | |
| 3,003,160 | | 10/1961 | Goodman . | |
| 3,533,658 | * | 10/1970 | Gropp | 297/362.13 |
| 3,580,635 | * | 5/1971 | Posh | 297/362.13 X |
| 3,630,569 | * | 12/1971 | Lory | 297/354.13 |
| 3,916,461 | | 11/1975 | Kerstholt . | |
| 4,004,836 | * | 1/1977 | Kristensson | 297/354.13 X |
| 4,371,996 | | 2/1983 | Nahum . | |

FOREIGN PATENT DOCUMENTS

| | | |
|---|---|---|
| 29 43 546 | 4/1985 | (DE) . |
| 43 00 426 | 7/1994 | (DE) . |
| 37 03 433 | 8/1996 | (DE) . |
| 2 194 142 | 3/1988 | (GB) . |
| 97/37567 | 10/1997 | (WO) . |

* cited by examiner

*Primary Examiner*—Anthony D. Barfield
(74) *Attorney, Agent, or Firm*—Finnegan, Henderson, Farabow, Garrett & Dunner, L.L.P.

(57) ABSTRACT

A piece of reclining or seating furniture is designed with two or more mutually adjustable articulated members (R, S, F), which together form an adjustable frame for support of a mattress, cushion, upholstery or the like. The adjustable frame is mounted in a support member (A) by means of horizontal axles/dowels, stays, sliding elements or the like, which constitute fulcrums (2, 3, 5) for the mutually adjustable, articulated members (R, S, F). The back member (R) has a fixed fulcrum (2) in relation to the support member (A), located at a distance from the linkage (1) to the seat member. The adjustment of the furniture's respective articulated members is performed via a fixed, downwardly projecting arm (6) mounted on the underside of the back member (R), in the area below the back member's fulcrum (2). For balancing the piece of furniture there is provided between an attachment point (14) on the arm (6) and a point (11) on the support member (A) or the frame (R, S, F), a spring mechanism (15), which is designed for exercise of a force of the same order as the force which is exerted on the back member (R) during adjustment between different user positions of the piece of furniture. The spring mechanism (15) can be locked.

5 Claims, 4 Drawing Sheets

Figure 3:
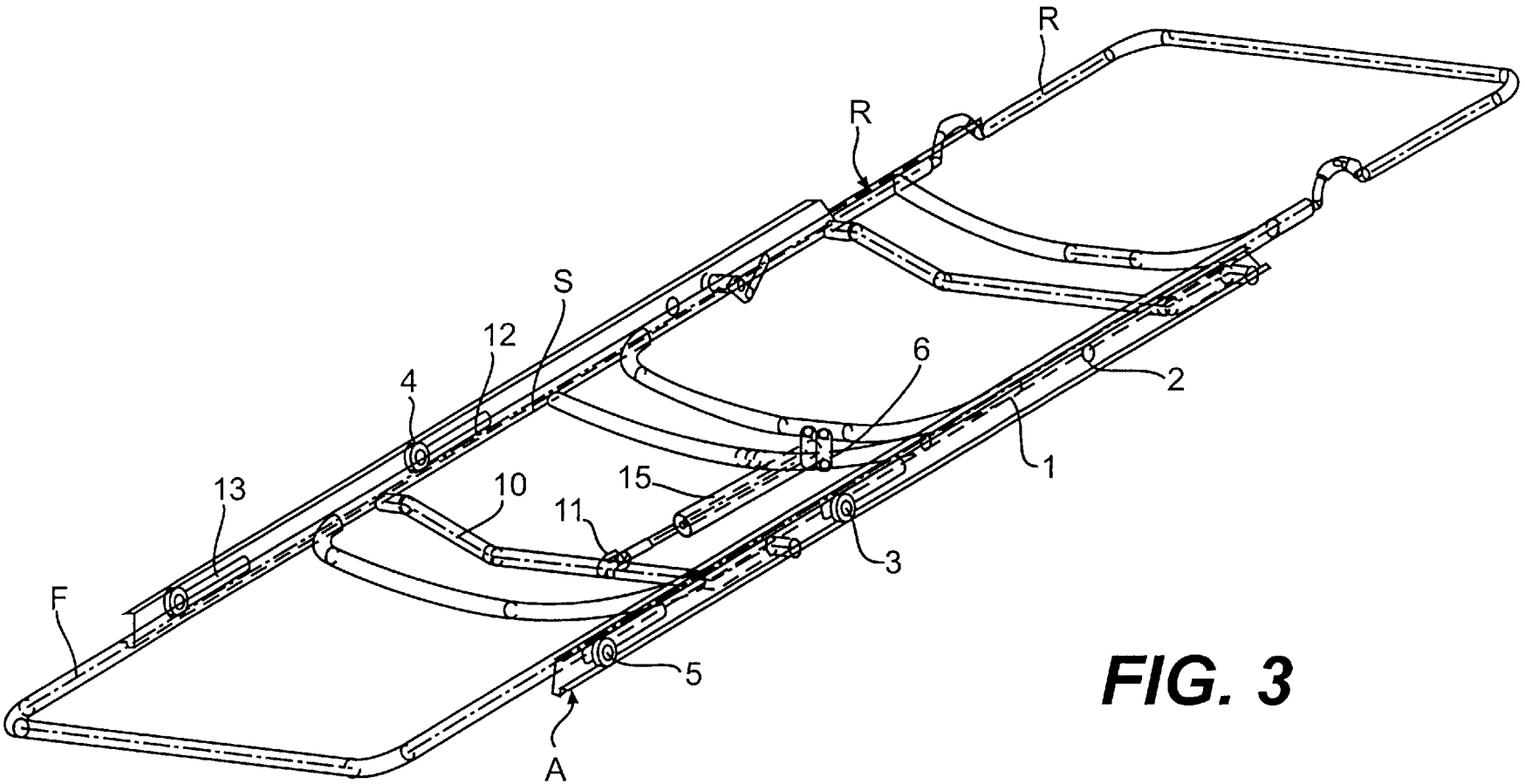

FIG. 1A
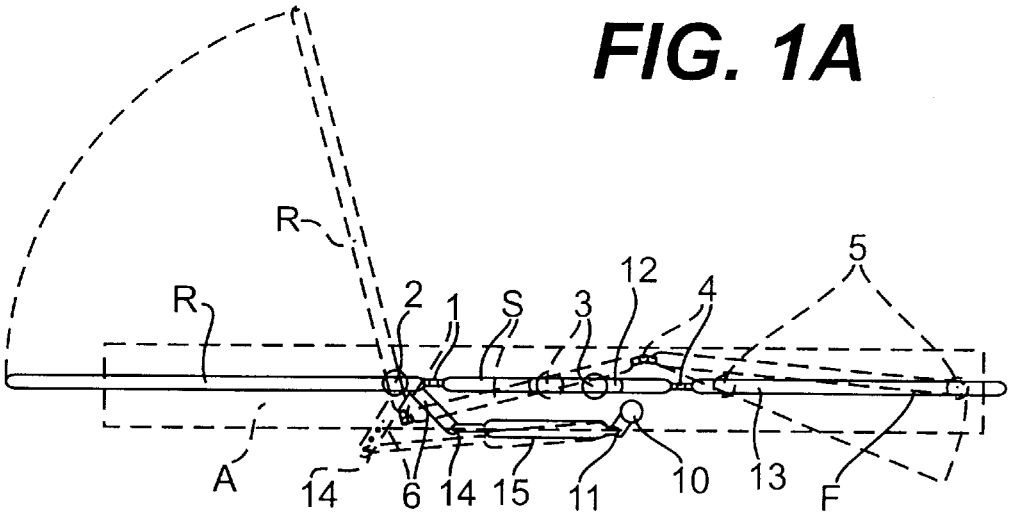
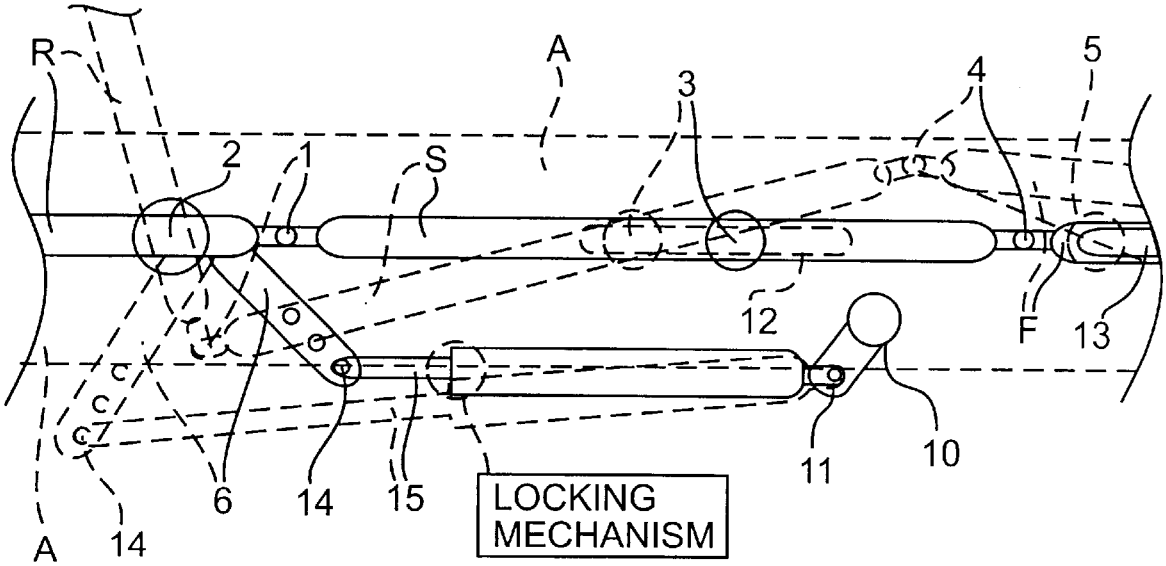
FIG. 1B

FIG. 2A
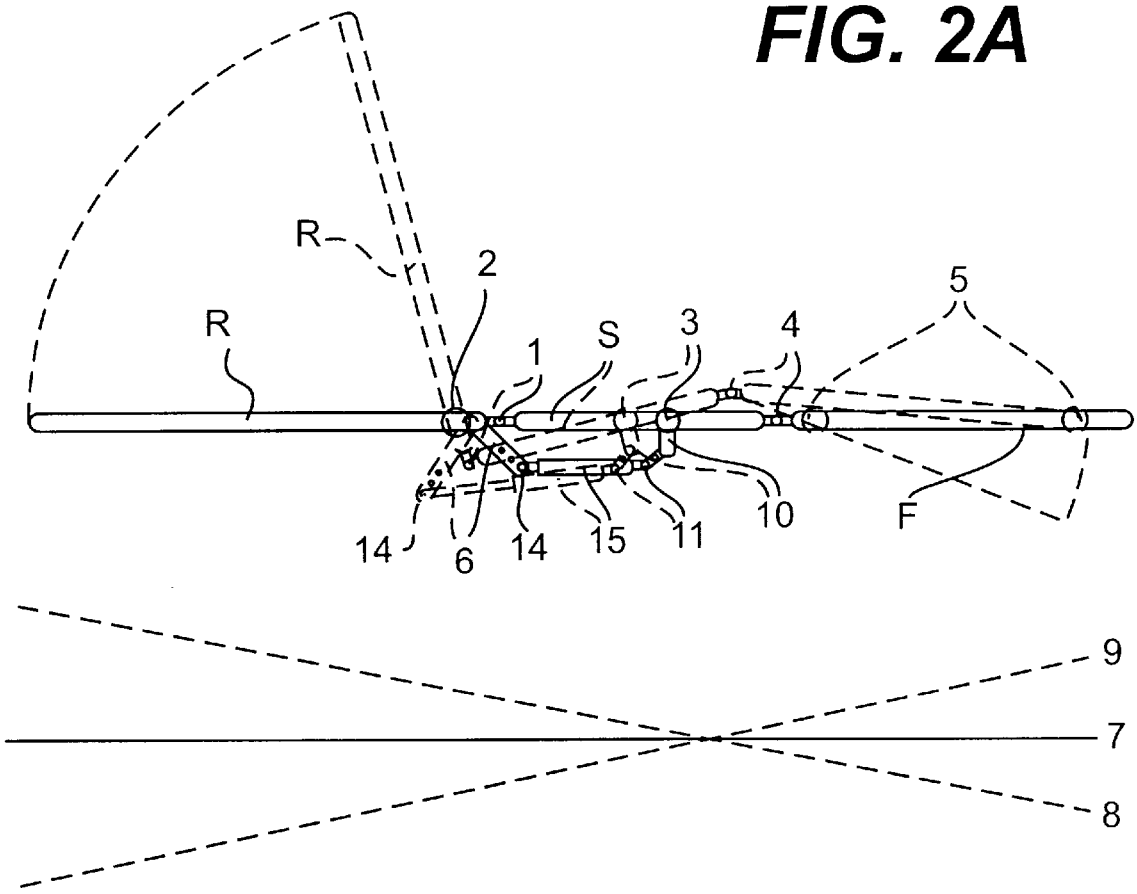
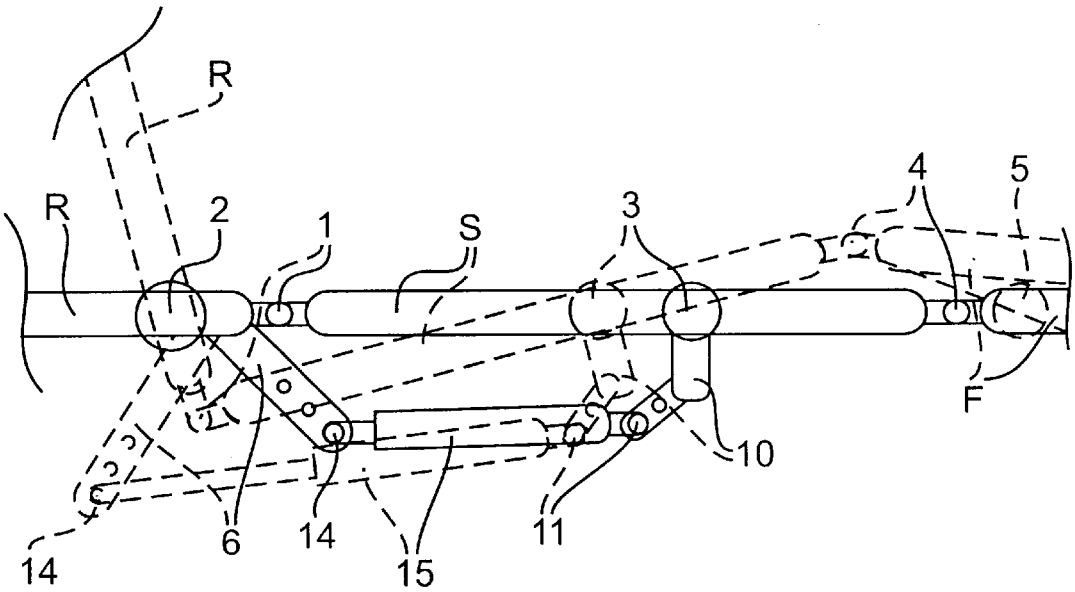
FIG. 2B

ARRANGEMENT FOR BEDS AND OTHER RECLINING OR SEATING FURNITURE

The invention concerns an arrangement for reclining or seating furniture, wherein the piece of furniture has two or more mutually adjustable, articulated members, which together form an adjustable frame for support of a mattress, cushions, upholstery or the like, where the adjustable frame is mounted in a support member by means of horizontal axles/dowels/stays/sliding elements or the like which constitute fulcrums for the mutually adjustable, articulated members, where the back member has a fixed fulcrum in relation to the support member, located at a distance from the linkage to the seat member, and where the adjustment of the furniture's respective articulated parts is performed via a fixed, downwardly projecting arm mounted on the underside of the back member in the area below the back member's fulcrum.

The terms reclining or seating furniture describe all types of furniture where it may be appropriate to adjust the user position, e.g. a bed, chaise longue, divan, bench, sofa, chair, etc. The furniture frame, composed of articulated parts, which forms the support for the furniture's upholstery, arrangement of cushions, a mattress or the like, is mounted in a support member, which may be a side member, gable, frame or other fixed components. The terms furniture, frame, support member are used in the following and in the patent claims are based on these definitions. In this connection it should also be noted that the support for the mattress, cushions etc. will naturally also form the support for the user of the furniture.

There are previously known a great number of different designs of adjustable reclining or seating furniture. An example of such articulated designs can be found in the applicant's Norwegian patent application no. 961441. Articulated furniture of this kind is widely used within the health sector, e.g. in connection with hospital beds, but is also employed to an ever-increasing extent as ordinary furniture. The adjustments of the furniture's parts to the various user positions can either by performed by motor power, which may be electrically, hydraulically or pneumatically driven. Other possibilities are mechanical operation via adjusting levers, or by the user taking hold of a part of the furniture and moving it by hand.

The invention concerns an arrangement for reclining or seating furniture in which it should be possible to perform the adjustment entirely without or with minimal help from external power sources i.e. without any kind of motor power whatever, while at the same time it should be possible to perform the adjustment of the furniture with a minimal exercise of force, directly by the user while he is reclining/sitting on the piece of furniture.

Thus it should be possible to perform a readjustment of the furniture. e.g. from a reclining position to a sitting position and back or to assume intermediate positions, essentially by the user simply performing a "natural movement", with the result that the furniture "follows" when the user readjusts from one position to the other.

From DE-A-2 943 546 there is known a hospital bed with an adjustable back member and foot member. In order to be able to adjust these two members both independently of each other and in combination there has been used two springs elements, which are provided either between the back member and the seat member or between the foot member and the seat member. In order to make it possible to combine the movement of these two members and also block them in different positions it is provided a further mechanism consisting of a sliding rod with surrounding sleeve elements, which provide a blockable linkage between the back member and the foot member.

From U.S. Pat. No. 3,916,461 it is known a further article which makes it possible to adjust back, seat and foot members of elements in a furniture. Also in this arrangement there has been used a spring system comprising at least two spring elements in order to move the respective members. The spring elements are connected to each other through arms connected to a common locking device, which can lock the members in different positions.

It is an object of the invention to provide an adjusting arrangement for reclining or seating furniture in which the exercise of force when changing position between various positions is balanced, with the result that the furniture essentially follows the user's movements, while at the same time the furniture can be locked in the respective positions.

This object is achieved with an arrangement of the type mentioned in the introduction, which is characterised by the features presented in the patent claims.

The invention is especially intended for use in connection with reclining or seating furniture as described in Norwegian patent application 961441, but will also be able to be used in many other types of adjustable furniture. In the invention, on the part of the furniture's adjustable frame, which controls the adjustment of the parts, there is attached a lever arm which forms the basis for mounting the spring mechanism which balances the adjustment. Between this arm and a point either on the frame or on one of the adjustable parts there is mounted a spring mechanism which compensates for the force which is required to move the frame members. By achieving a correct balance, the user lying in a bed will be able to sit up and by means of this movement, merely by exerting pressure on the seat member, he will cause a rotation of the back member towards a sitting position and a slighter raising of the seat member at the foot end, with the result that these parts are adjusted without any appreciable exercise of force. After achieving the desired position, the user can operate a locking knob, which locks the spring mechanism in this position, if so desired.

For height adjustment it is advantageous to employ a gas spring of the same type which is employed in office chairs. Such gas springs are equipped with locking means and these only need to be adapted to the special shape of the piece of furniture. Instead of a gas spring it will also be possible to employ, e.g. a compression spring or another suitable spring device which is attached in a similar manner. The type of spring mechanism is of no importance for the invention and the attachment of the spring's other end will be adapted to the choice of spring system. The use of intermediate rod elements or also cord extensions may also be envisaged in this context. All such modifications are intended to fall within the scope of the invention. If the spring component has no associated locking mechanism, it will be possible to provide a separate locking mechanism on the furniture.

Similarly, it will be possible to employ two or more spring mechanisms. The spring mechanism may also be provided at an oblique angle in relation to the furniture's longitudinal direction, e.g. for reasons of strength.

Figure 4:
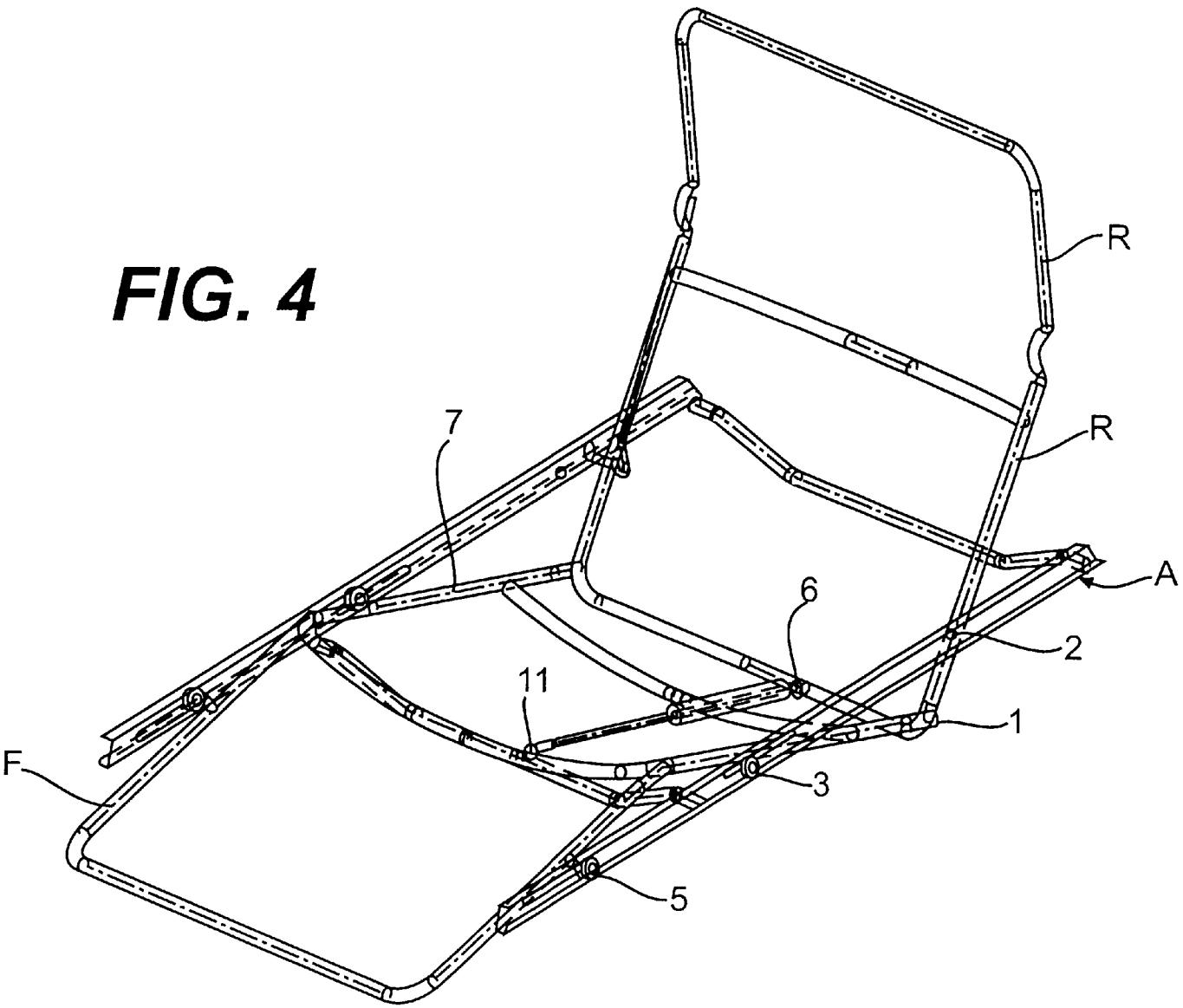

The invention will now be described in more detail by means of embodiments which are illustrated in the drawing, in which:

FIG. 1A is a schematic principle drawing of a piece of reclining/seating furniture with an arrangement according to the invention in its first embodiment, FIG. 1B is an enlarged detail drawing of FIG. 1A, FIGS. 2A–B are similar views of a second embodiment, FIG. 3 is a perspective view illustrating the invention in a first position for the piece of furniture, FIG. 4 is a similar view in a second position for the piece of furniture.

The illustrations in the figures are based on an adjustable frame with articulated parts, based on the principles which are protected in Norwegian patent application no. 961441. As mentioned above, these framework designs are only used for illustration of the concept of the invention, the balancing being the object of the present case.

In the examples the furniture's adjustable frame is described as frames consisting of a back member R, a seat member S and a front member F. It is also possible to employ the invention on a frame consisting of only two parts, e.g. R and S, or also a frame consisting of more than three parts.

The fulcrums for the three frame members illustrated in the drawing are designated 2, 3 and 5 respectively, while the linkages between back member and seat member with seat member and foot member respectively are designated 1 and 4. In FIGS. 1A and 1B the frame's support member A is indicated by a dash and dot line. In the illustrated example there are provided therein slots 12 and 13 in which the fulcrums 3 and 5 can move. This mechanism is also illustrated in FIGS. 3 and 4, where there are only shown two guide rails of the support frame A with the slots or grooves 12 and 13. It should be emphasised that these elements belong to the adjustment system. In the area between the back member's fulcrum 2 and the linkage to the seat member S there is provided a downwardly projecting arm 6 which is securely connected with the back member R. In the illustrated embodiment this arm 6 is provided at an obtuse angle relative to the back member, with the result that it projects in under the seat member when the back member is folded down, the piece of furniture thus forming a reclining surface. In this arm 6 there are provided three holes, as is best illustrated in FIGS. 1B and 2B.

In the drawing there is also illustrated by dash and dot lines the support member A, in which the adjustable frame is mounted. In this support member A there is mounted a crossbar 10 which leads from one longitudinal side of the piece of furniture to the other (see FIG. 3). On this crossbar 10 there is attached, e.g. welded, an attachment lug with a mounting hole 11. Between a suitable mounting hole 14 in the arm 6 and the hole 10 in the lug on the crossbar 10 there is mounted a spring mechanism, e.g. a gas spring 15, which is illustrated purely schematically in the drawing. This spring mechanism may also be a compression spring, or it can be designed in another suitable manner. With the illustrated mounting the spring or the spring element 15 will be designed so as to exert a force on the arm 6 when the back member is in a "reclining position". The spring mechanism will be locked, with a locking mechanism shown schematically in FIG. 1B, thus holding it in this position.

When the user sits up in the piece of furniture, he will exert a force with the lower part of his body on the seat member S. At the same time the user will release the locking mechanism, e.g. by means of a lever which influences a wire mechanism down to a gas spring locking member. This releasing action will cause a force exerted by the user of the furniture exerts when he sits up to generate a movement of the articulated members, as described, e.g., in Norwegian patent application 961441, and the frame members move, e.g. to the position illustrated by dot and dash lines in FIGS. 1A, 1B. At the same time the spring mechanism, e.g. the gas spring 15, which has now been released, will exert a pressure against the arm 6 which will be of the same magnitude as the force which is overcome in order to move the members relative to one another. This force may also, at least partially, compensate for the exercise of force on the part of the user. When the user has reached the desired position, he can operate the locking body, thus locking the spring in the desired position, if he so desires.

Should the user again wish to return to a reclining position, he releases the spring's locking mechanism if it is locked and leans back. Due to the balancing of the forces which has been achieved by means of the spring mechanism, the back member and the other members will thereby move back to the horizontal position in a balanced manner, without giving the feeling that the back member is falling down.

The exercise of force from the spring component 15 can be easily adjusted by moving the attachment from one hole 14 to another hole 14 in the arm 6. This can be done according to the example with, e.g., a type of mattress element which is lying on the support member or whether the user is a heavy or light person, since the length of the arm 6 is thereby varied. An adjustment of this kind is preferably performed once and for all, thus making it a permanent adaptation, but an alteration may of course also be undertaken at other times. Another alternative for variation, of course, is to use a spring component with a different spring force.

The furniture's pattern of movement and attachment otherwise correspond to that which is described in FIGS. 1 and 8 in Norwegian patent application no. 9611441.

In FIGS. 2A and 2B there is described a second embodiment of the invention. The actual furniture design corresponds to that which is illustrated in FIG. 1, but in this embodiment the attachment lug 11 for the spring mechanism 15 is not attached to a point on the support member, but to a crossbar which is attached to the seat member's pivots or fulcrums 3. In this embodiment where the seat member, e.g. to the pivots or fulcrum 3, is movable in the furniture's longitudinal direction, the stay 10 to the attachment lug 11 will also be moved in the furniture's longitudinal direction. In FIG. 2B it is also shown that more adjustment possibilities can be obtained by providing more mounting holes in the lug 11. In this case too the spring mechanism 15 is attached between the lug 11 and the arm 6 and the arrangement works according to exactly the same principle as that illustrated in FIG. 1, even though the spring mechanism will move to a certain extent during the process of adjusting the furniture. This can, however, reduce the movements to some extent, which may be advantageous.

FIGS. 3 and 4 illustrate in perspective a design with a gas spring 15, which can be arranged slightly on a slant if required on account of the rigidity of the respective stays. A longer spring component may also be provided in this manner. The illustrations are intended to show that alternatives exist for mounting the spring element.

A further, not illustrated alternative is, instead of using a compression spring device, to use a spring device with opposite pressure direction, thereby enabling the spring to be provided on the opposite side of the arm 6 and, e.g., attached to an end frame of the furniture. Thus many modifications are possible within the scope of the invention. Even though the arm 6 in the illustrated embodiments is illustrated mounted at an oblique angle, this is not a condition, and attachment of the spring component at the other end may also be performed in many different ways. Nor is the invention dependent on the number of parts in the adjustable frame, the essential factor being that a balancing is undertaken of the spring component's force in accordance with the forces which must be exerted in order to set the various user positions for the furniture.

What is claimed is:

1. In a reclining or seating piece of furniture having an adjustable frame for supporting a mattress, cushions, or upholstery and having adjustably articulated back and seat members joined by a pivotal connection, the adjustable frame being mounted in a support member by horizontal axles defining fulcrums for the articulated back and seat members, the back member having a fixed fulcrum pivoted in the support member and located at a distance from the pivotal connection, the seat member having a slidable fulcrum in a central region thereof that is slidable along and pivotal relative to the support member, adjustment of the respective articulated back and seat members being performed via a fixed, downwardly projecting arm extending from the back member to an attachment point beyond the fixed fulcrum of the back member, and a spring mechanism provided between the attachment point on downwardly projecting arm and a reaction point on one of the support member or the adjustable frame, the improvement wherein:

the spring mechanism is at least one gas spring for exerting a force against the attachment point on the downwardly projecting arm on the back member, the attachment point being adjustable in dependence on one of a weight or frictional load on the piece of furniture, so that the spring mechanism exerts a force of the same order as the force exerted on the back member during any adjustment between different positions of the piece of furniture, and wherein the spring mechanism includes a locking mechanism for locking the spring mechanism in any position.

2. The reclining or seating piece of furniture of claim 1, wherein the spring mechanism is arranged at an angle to a longitudinal direction of the piece of furniture with an attachment in the central area of a fixed frame member.

3. The reclining or seating piece of furniture of claim 1, including two cooperating spring mechanisms.

4. The reclining or seating piece of furniture of claim 1, wherein the spring mechanism may be attached to the support member in an adjustable manner.

5. The reclining or seating piece of furniture of claim 1, wherein the spring mechanism is a compression spring.

* * * * *